US011493253B2

(12) United States Patent
Lee et al.

(10) Patent No.: US 11,493,253 B2
(45) Date of Patent: Nov. 8, 2022

(54) EVAPORATOR FOR ICE MAKER

(71) Applicant: COWAY Co., Ltd., Gongju-Si (KR)

(72) Inventors: Gyeong-Min Lee, Seoul (KR); Jung-Hwan Lee, Seoul (KR); Kyu-Jun Kim, Seoul (KR); Doo-Youl Jeon, Seoul (KR); Myeong-Hoon Kang, Seoul (KR); Jin-Woo Choi, Seoul (KR); Kwon-Jae Lee, Seoul (KR); Jae-Man Kim, Seoul (KR)

(73) Assignee: COWAY Co., Ltd., Gongju-Si (KR)

( * ) Notice: Subject to any disclaimer, the term of this patent is extended or adjusted under 35 U.S.C. 154(b) by 0 days.

(21) Appl. No.: 17/275,992

(22) PCT Filed: Sep. 4, 2019

(86) PCT No.: PCT/KR2019/011413
§ 371 (c)(1),
(2) Date: Mar. 12, 2021

(87) PCT Pub. No.: WO2020/055032
PCT Pub. Date: Mar. 19, 2020

(65) Prior Publication Data

US 2022/0034571 A1 Feb. 3, 2022

(30) Foreign Application Priority Data

Sep. 14, 2018 (KR) ..... 10-2018-0110494

(51) Int. Cl.
*F25C 5/08* (2006.01)
*F25C 1/045* (2018.01)

(52) U.S. Cl.
CPC ..... *F25C 5/08* (2013.01); *F25C 1/045* (2013.01); *F25C 2600/04* (2013.01)

(58) Field of Classification Search
CPC .... F25C 5/08; F25C 1/08; F25C 1/045; F25C 2600/04
See application file for complete search history.

(56) References Cited

FOREIGN PATENT DOCUMENTS

KR 20-0457271 Y1 12/2011
KR 10-2013-0013475 A 2/2013
(Continued)

OTHER PUBLICATIONS

Machine English language translation of KR 20140006488 to Lee. (Year: 2014).*

(Continued)

*Primary Examiner* — Cassey D Bauer
(74) *Attorney, Agent, or Firm* — Oblon, McClelland, Maier & Neustadt, L.L.P.

(57) ABSTRACT

An evaporator for an ice maker includes an evaporator body having a refrigerant flow path formed therein; a dipping member connected to the evaporator body, for a refrigerant having a temperature lower than a freezing point of water to flow in the refrigerant flow path to generate ice in a state in which at least a portion of the dipping member is submerged in water; a heater having at least a portion inserted into the refrigerant flow path, and directly or indirectly heating at least one of the refrigerant in the refrigerant flow path, the evaporator body, and the dipping member to separate the ice generated on the dipping member from the dipping member; and a connection member connecting the evaporator body and the refrigerant flow path to be connected to a refrigeration cycle, and inserting the at least a portion of the heater into the refrigerant flow path.

15 Claims, 11 Drawing Sheets

(56) References Cited

FOREIGN PATENT DOCUMENTS

| | | | | | |
|---|---|---|---|---|---|
| KR | 20130095974 | | * | 8/2013 | ..... F25C 1/22 |
| KR | 10-2013-0104467 | A | | 9/2013 | |
| KR | 10-2014-0006488 | A | | 1/2014 | |
| KR | 10-2015-0088016 | A | | 7/2015 | |
| KR | 10-2017-0047082 | A | | 5/2017 | |
| KR | 10-2017-0100190 | A | | 9/2017 | |
| KR | 20170114306 | | * | 10/2017 | ..... F25C 1/246 |
| KR | 10-2018-0047158 | A | | 5/2018 | |

OTHER PUBLICATIONS

International Search Report dated Dec. 16, 2019 in PCT/KR2019/011413 filed Sep. 4, 2019, 2 pages.
Extended European Search Report dated Oct. 20, 2021 in European Patent Application No. 19861141.0, 7 pages.
Chinese Office Action dated May 25, 2022 in Chinese Patent Application No. 201980060306.7, (with English language translation), 18 pages.

* cited by examiner

II–II'

II–II'

EVAPORATOR FOR ICE MAKER

TECHNICAL FIELD

The present invention relates to an evaporator used in an ice maker for making ice.

BACKGROUND ART

An ice maker is a device for making ice. To this end, the ice maker may include an evaporator through which a refrigerant flows.

In a state in which a refrigerant having a temperature lower than the freezing point of water flows through the evaporator, when water is in contact with at least a portion of the evaporator or at least a portion of a member connected to the evaporator, ice may be generated on the evaporator or the member connected to the evaporator.

When ice having a predetermined size is generated on the evaporator or the member connected to the evaporator, the ice should be separated from the evaporator or the member connected to the evaporator.

To this end, in the related art, a refrigerant having a temperature higher than a freezing point of water may flow into an evaporator, or a heater may be provided outside the evaporator to heat the evaporator.

However, when the refrigerant having a temperature higher than the freezing point flows into the evaporator, noise was generated by a flow path switching valve used for this purpose, and when a heater is provided outside the evaporator, the evaporator was heated to a high temperature and thus resistance to corrosion may decrease.

DISCLOSURE

Technical Problem

The present invention has been made by recognizing at least one of the above demands or problems occurring in the prior art.

An aspect of the present invention is to minimize generation of noise when ice generated by an evaporator is separated, and to prevent a decrease in resistance to corrosion of the evaporator due to the separation of the ice generated by the evaporator.

Another aspect of the present invention is to insert at least a portion of a heater separating ice generated by an evaporator into a refrigerant flow path formed in the evaporator for a refrigerant to flow.

Technical Solution

An evaporator for an ice maker, according to an embodiment, for realizing at least one of the above problems may include the following features.

According to an aspect of the present invention, an evaporator for an ice maker, includes an evaporator body having a refrigerant flow path formed therein; a dipping member connected to the evaporator body, for a refrigerant having a temperature lower than a freezing point of water to flow in the refrigerant flow path to generate ice in a state in which at least a portion of the dipping member is submerged in water; a heater having at least a portion inserted into the refrigerant flow path, and directly or indirectly heating at least one of the refrigerant in the refrigerant flow path, the evaporator body, and the dipping member to separate the ice generated on the dipping member from the dipping member; and a connection member connecting the evaporator body and the refrigerant flow path to be connected to a refrigeration cycle, and inserting the at least a portion of the heater into the refrigerant flow path.

In the evaporator, the at least a portion of the heater may pass through the connection member and may be inserted into the refrigerant flow path, or at least a portion of a heater insertion pipe into which the at least a portion of the heater is inserted may pass through the connection member and may be inserted into the refrigerant flow path.

In addition, the heater insertion pipe may be configured to close one side and open the other side, and the at least a portion of the heater may be inserted into the opened the other side of the heater insertion pipe.

In addition, a connection flow path connected to the refrigerant flow path and the refrigeration cycle and through which the at least a portion of the heater or the at least a portion of the heater insertion pipe passes may be formed in the connection member.

In addition, one side of the connection member may be connected to the evaporator body to connect the connection flow path and the refrigerant flow path, and a connection pipe connected to the refrigeration cycle may be connected to the other side of the connection member to be connected to the connection flow path, wherein the at least a portion of the heater or the at least a portion of the heater insertion pipe may pass through the other side of the connection member, may pass through the connection flow path, and may be inserted into the refrigerant flow path.

In addition, a through-hole connected to the connection flow path and through which the at least a portion of the heater or the at least a portion of the heater insertion pipe sealedly passes, and a connection hole connected to the connection flow path and to which at least a portion of the connection pipe is sealedly connected, may be formed on the other side of the connection member.

In addition, a diameter of at least a portion of the connection member may be greater than the sum of a diameter of the heater or a diameter of the heater insertion pipe and a diameter of the connection pipe.

In addition, a connection space connected to the refrigerant flow path may be formed in the dipping member to flow the refrigerant in the refrigerant flow path.

In addition, the dipping member may include a partition member partitioning the connection space into a refrigerant inflow path into which the refrigerant flows from the refrigerant flow path and a refrigerant outflow path from which the refrigerant flows into the refrigerant flow path.

In addition, the partition member may include a communication hole through which the refrigerant inflow path and the refrigerant outflow path are communicated to allow the refrigerant in the refrigerant inflow path to flow to the refrigerant outflow path.

In addition, the partition member may at least partially pass through the refrigerant flow path to extend to the evaporator body, and the partition member may at least partially be in contact with the dipping member and the evaporator body.

In addition, a portion of the partition member extending to the evaporator body may at least partially be in contact with the heater or the heater insertion pipe to support the heater or the heater insertion pipe.

In addition, the partition member may include a through support portion at least partially contacting the heater or the heater insertion pipe to pass through and support the heater or the heater insertion pipe.

In addition, the heater or the heater insertion pipe may at least partially be in contact with the evaporator body.

In addition, at least one group selected from the groups consisting of the evaporator body and the dipping member, the partition member and the dipping member, the heater or heater insertion pipe and the through support portion, or the heater or heater insertion pipe and the evaporator body may be connected by brazing.

In addition, the heater may include a heater body, a heating element provided inside the heater body and electrically connected to a power source, and a fuse blocking electrical connection between the heating element and the power source when the heating element generates heat having an abnormal heating temperature.

In addition, when the heater is not inserted into the heater insertion pipe, the fuse may be electrically connected to the heating element and the power source outside the heater body after the brazing, and when the heater is inserted into the heater insertion pipe, the fuse may be electrically connected to the heating element and the power source inside the heater body.

Advantageous Effects

According to an aspect of the present invention, at least a portion of a heater separating ice generated by an evaporator may be inserted into a refrigerant flow path formed in the evaporator for a refrigerant to flow.

In addition, according to an aspect of the present invention, the generation of noise when ice generated by an evaporator is separated may be minimized, and resistance to corrosion of the evaporator may not decrease due to the separation of the ice generated by the evaporator.

DESCRIPTION OF DRAWINGS

FIG. 6 illustrates a view in making ice, and FIG. 7 illustrates a view of removing ice.

MODE FOR INVENTION

Figure 1:
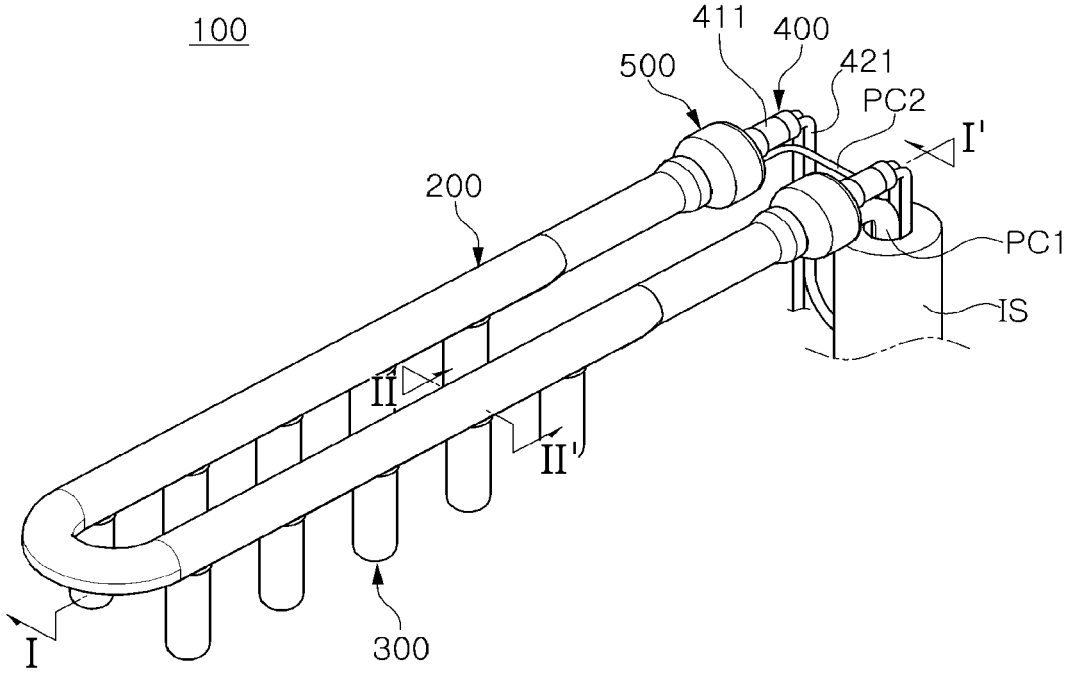
FIG. 1 is a perspective view of a first embodiment of an evaporator for an ice maker, according to the present invention.

In order to help understand the features of the present invention as described above, an evaporator for an ice maker related to an embodiment of the present invention will be described in more detail below.

Hereinafter, embodiments most appropriate to help in an understanding of the technical features of the present invention will be described, the technical features of the present invention are not limited by the described embodiments and merely illustrate the implementation of the present invention through the embodiments described hereinafter. Thus, the present invention can be variably modified within the scope of the present invention through the embodiments described below, and such modifications are within the scope of the present invention. In order to help understand the embodiments described hereinafter, the like or similar reference numerals are used for relevant components among the components having the same function in the respective embodiments in the accompanying drawings.

First Embodiment of Evaporator for Ice Maker

Hereinafter, a first embodiment of an evaporator for an ice maker according to the present invention will be described with reference to FIGS. 1 to 7.

Figure 2:
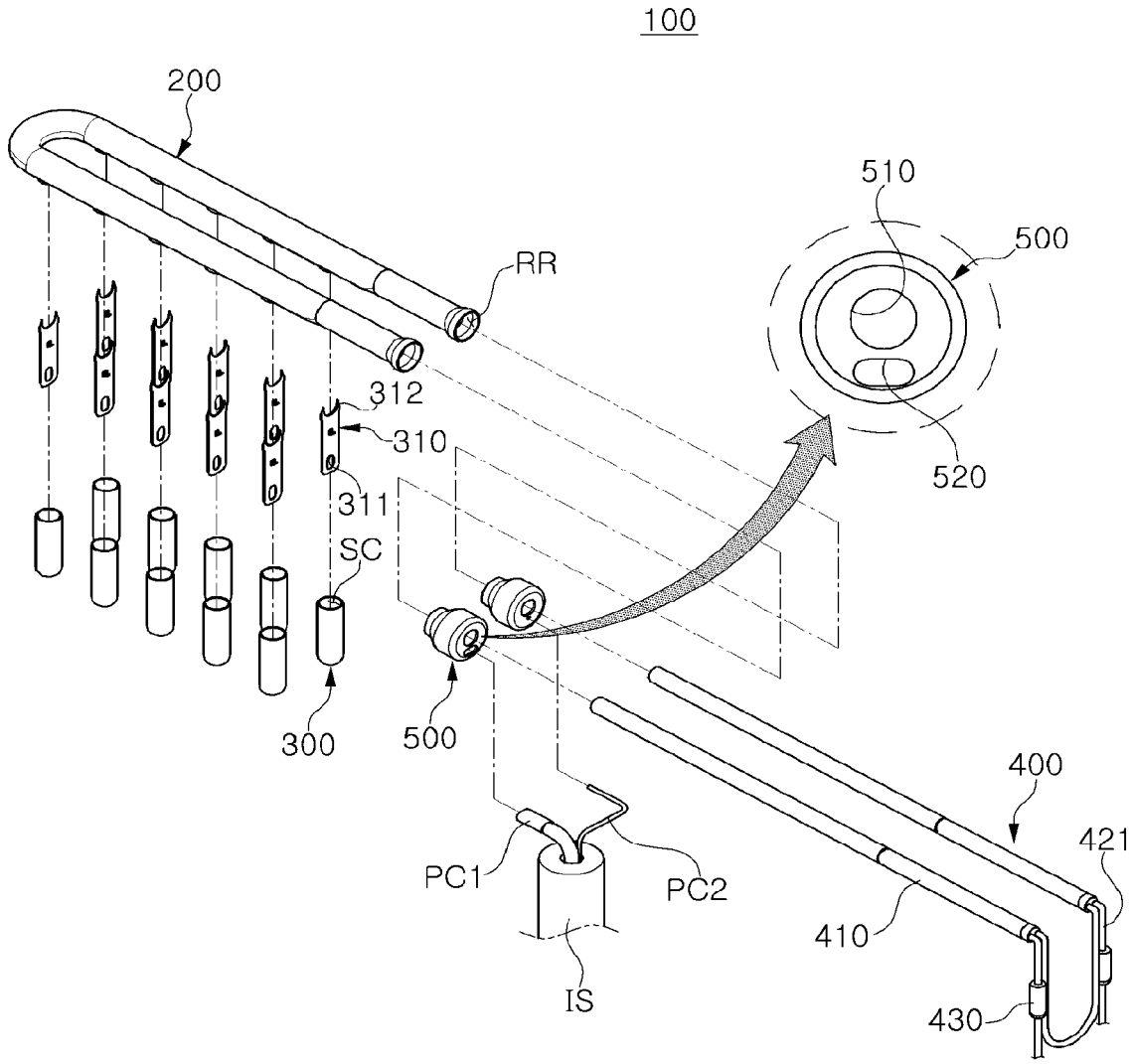
FIG. 2 is an exploded perspective view of a first embodiment of an evaporator for an ice maker, according to the present invention.

FIG. 1 is a perspective view of a first embodiment of an evaporator for an ice maker, according to the present invention, and FIG. 2 is an exploded perspective view of a first embodiment of an evaporator for an ice maker, according to the present invention.

Figure 3:
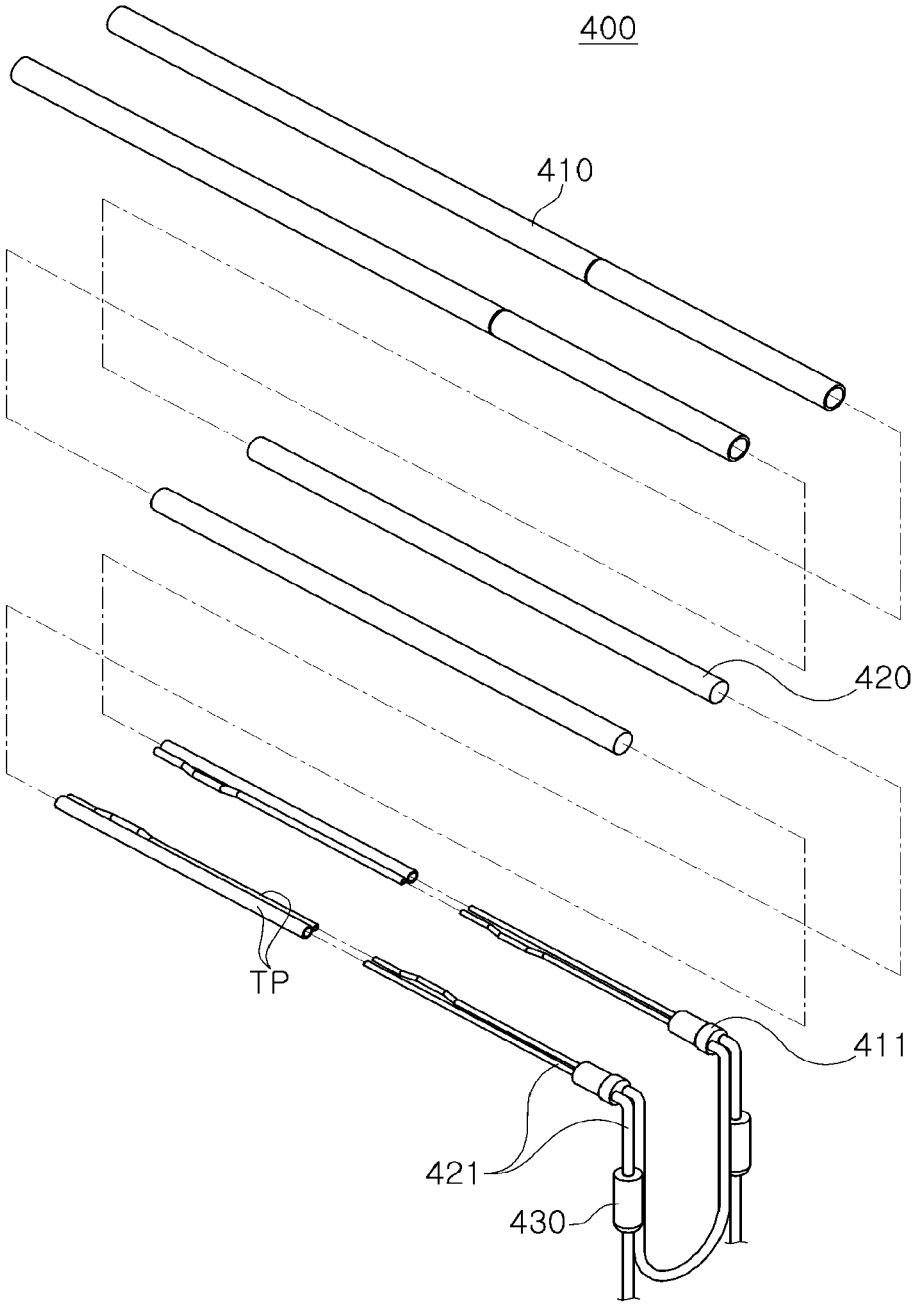
FIG. 3 is an exploded perspective view illustrating a heater of a first embodiment of an evaporator for an ice maker, according to the present invention.

Further, FIG. 3 is an exploded perspective view illustrating a heater of a first embodiment of an evaporator for an ice maker, according to the present invention.

Figure 4:
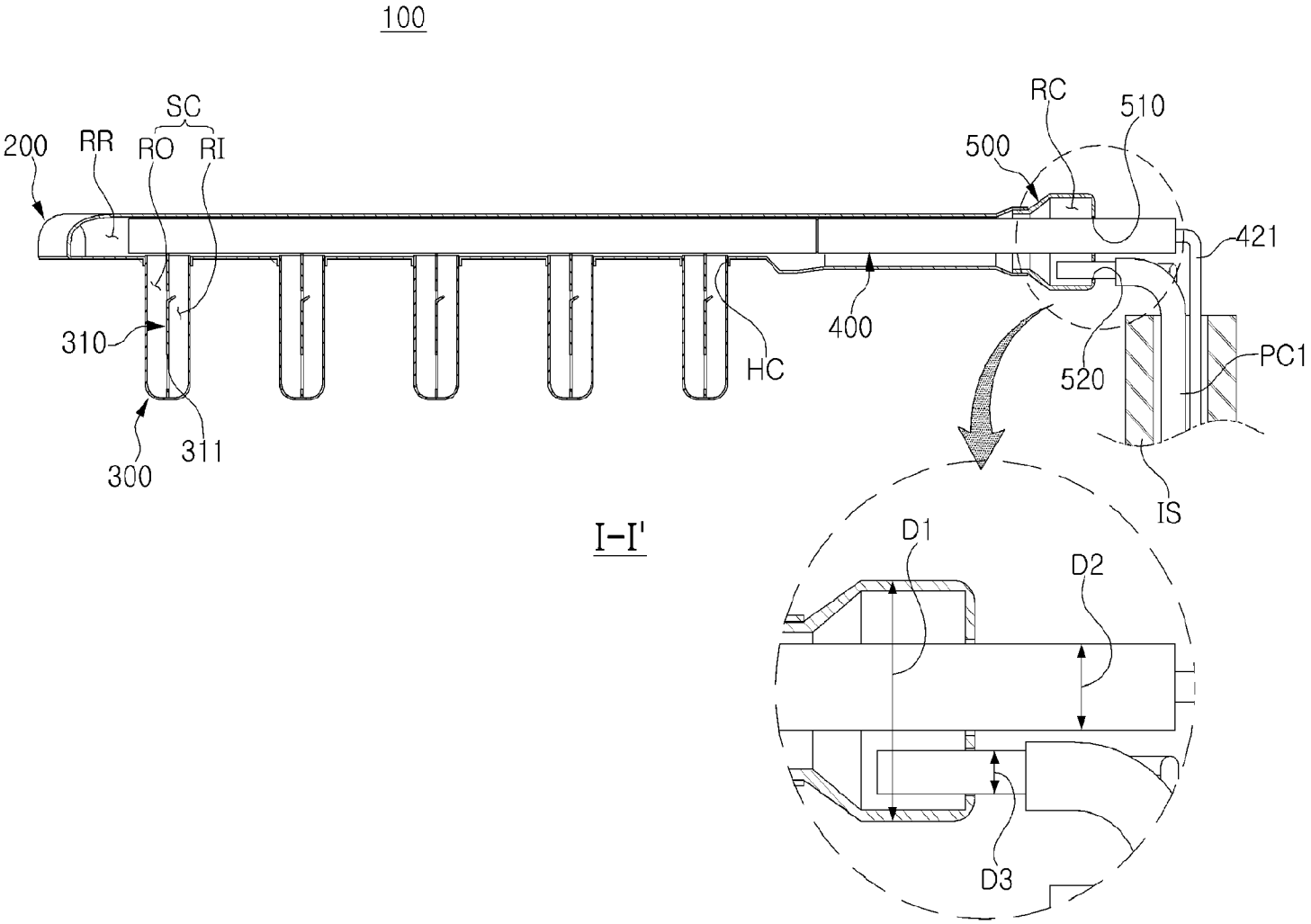
FIG. 4 is a cross-sectional view of FIG. 1, taken along line I-I'.
Figure 5:
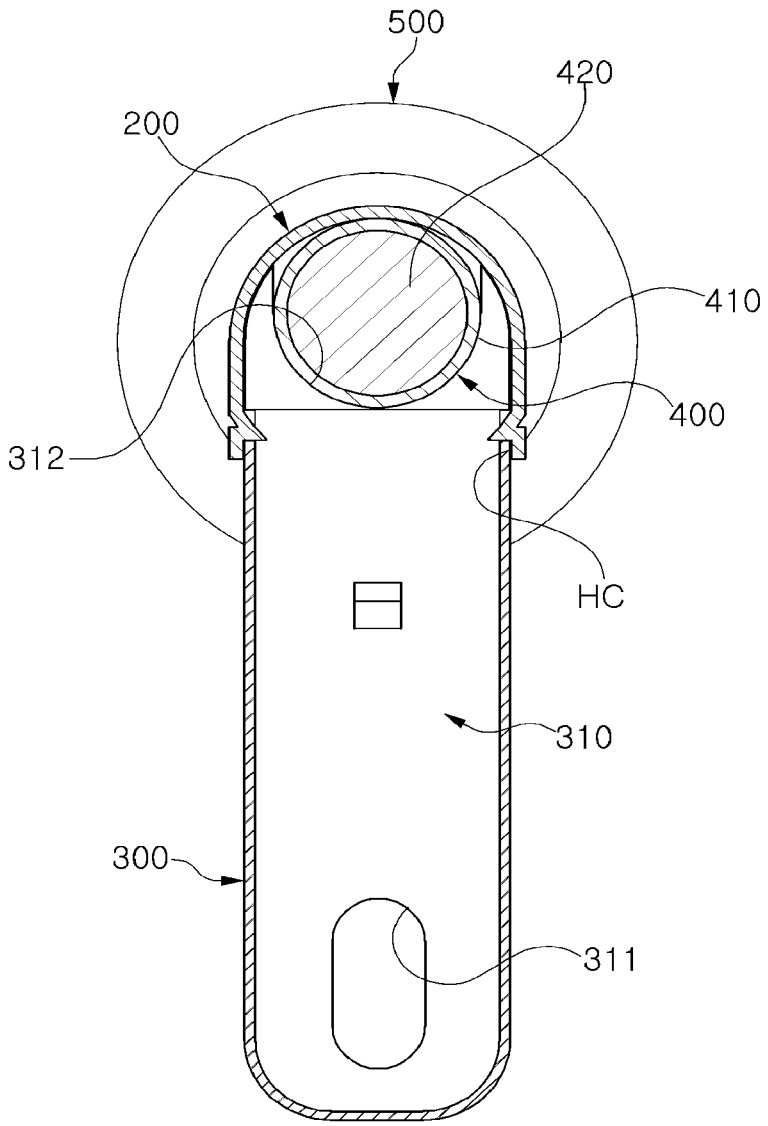
FIG. 5 is a cross-sectional view of FIG. 1, taken along line II-II'.

In addition, FIG. 4 is a cross-sectional view of FIG. 1, taken along line I-I', and FIG. 5 is a cross-sectional view of FIG. 1, taken along line II-II'.

Figure 6:
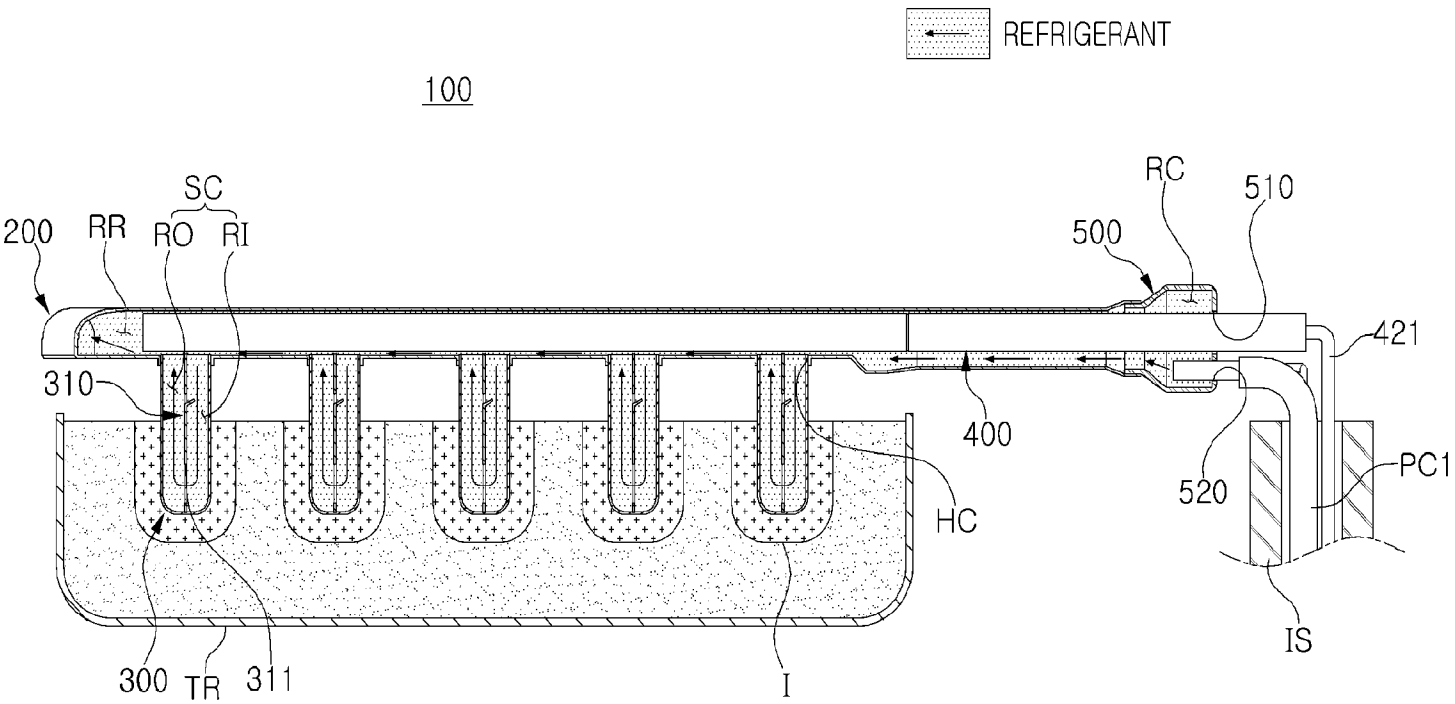
FIGS. 6 and 7 are cross-sectional views illustrating an operation of a first embodiment of an evaporator for an ice maker, according to the present invention.
Figure 7:
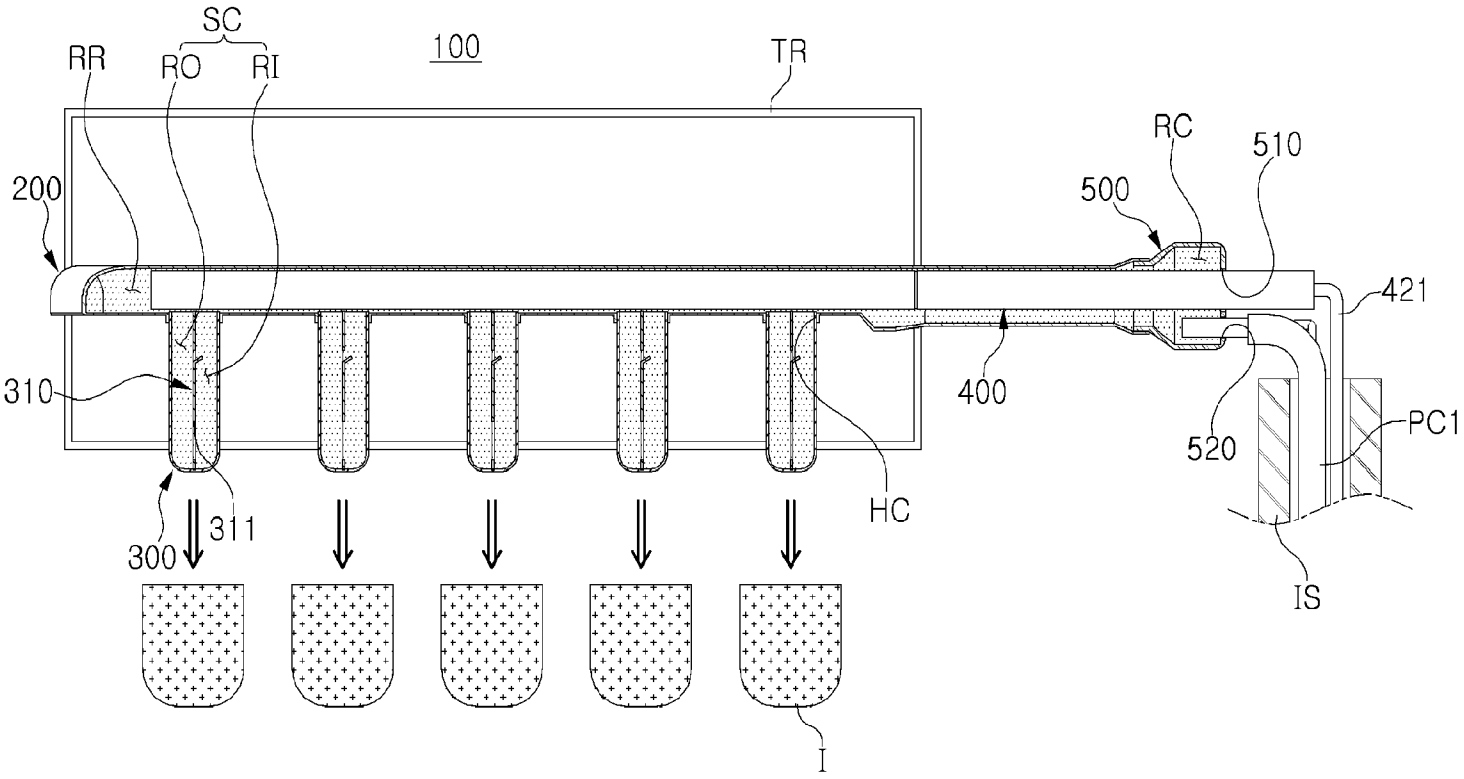

FIGS. 6 and 7 are cross-sectional views illustrating an operation of a first embodiment of an evaporator for an ice maker, according to the present invention, and FIG. 6 illustrates a view in making ice, and FIG. 7 illustrates a view in removing ice.

An embodiment of an evaporator 100 for an ice maker according to the present invention may include an evaporator body 200, a dipping member 300, a heater 400, and a connection member 500.

A refrigerant flow path RR may be formed in an evaporator body 200, as illustrated in FIGS. 2 and 4. The refrigerant flow path RR may be connected to a refrigeration cycle (not illustrated) through the connection member 500 as described later, for a refrigerant to flow, as illustrated in FIG. 6.

For example, one side of the refrigerant flow path RR may be connected to a capillary tube or an expansion valve (not illustrated) included in the refrigeration cycle, through the connection member 500, and the other side of the refrigerant flow path RR may be connected to a compressor (not illustrated) included in the refrigeration cycle, through the connection member 500. As a result, a refrigerant having a temperature lower than a freezing point of water may flow through the refrigerant flow path RR, as illustrated in FIG. 6.

The evaporator body 200 may be a U-shaped tube in which the refrigerant flow path RR is formed, as illustrated in FIGS. 1 and 2. A shape and a configuration of the evaporator body 200 are not particularly limited, and any shape and configuration such as a straight tube may be used as long as it is a shape and a configuration in which the refrigerant flow path RR is formed.

In the evaporator body 200, for example, a member connection hole HC may be formed in a lower portion of the evaporator body 200, as illustrated in FIGS. 4 and 5. The dipping member 300 may be connected to the evaporator body 200 through the member connection hole HC.

The evaporator body 200 may be formed of a thermally conductive material. For example, the evaporator body 200 may be formed of metal such as stainless steel. A material constituting the evaporator body 200 is not particularly limited, and any known material may be used as long as it is a material in which the refrigerant flow path RR is formed.

The dipping member 300 may be connected to the evaporator body 200. As illustrated in FIG. 1, a plurality of dipping members 300 may be connected to the evaporator body 200. The number of dipping members 300 connected to the evaporator body 200 is not particularly limited, and any number may be used, and one (1) dipping member 300 may be connected to the evaporator body 200.

The dipping member 300 may be connected to the evaporator body 200, and may be, for example, connected to the evaporator body 200 in a state in which one end portion of the dipping member 300 is inserted into the member connection hole HC, as illustrated in FIGS. 4 and 5, by brazing. A configuration in which the dipping member 300 is connected to the evaporator body 200 is not particularly limited, and any known configuration, such as connection by engagement, an adhesive, or the like, may be used.

At least a portion of the dipping member 300 may be submerged in water. For example, as illustrated in FIG. 6, the dipping member 300 may be at least partially submerged in water contained in a tray member TR. In this state, when a refrigerant having a temperature lower than a freezing point of water flows in the refrigerant flow path RR of the evaporator body 200, ice I may be generated on the dipping member 300.

A connection space SC connected to the refrigerant flow path RR of the evaporator body 200 may be formed in the dipping member 300, as illustrated in FIGS. 2 and 4. Therefore, as illustrated in FIG. 6, the refrigerant flowing through the refrigerant flow path RR of the evaporator body 200 may flow through the connection space SC of the dipping member 300. By this, the dipping member 300 may be directly cooled by a refrigerant having a temperature lower than a freezing point of water, to generate ice I more quickly and easily on the dipping member 300.

A partition member 310 may be provided in the dipping member 300. The connection space SC of the dipping member 300 may be divided into a refrigerant inflow path RI and a refrigerant outflow path RO by the partition member 310, as illustrated in FIG. 4. In addition, a communication hole 311 may be formed in the partition member 310, as illustrated in FIGS. 2, 4, and 5, and the refrigerant inlet path RI and the refrigerant outflow path RO, partitioned by the partition member 310, may communicate with each other.

Therefore, the refrigerant flowing through the refrigerant flow path RR of the evaporator body 200 may flow into the refrigerant inflow path RI of the connection space SC of the dipping member 300, as illustrated in FIG. 6. In addition, the refrigerant in the refrigerant inflow path RI may flow into the refrigerant outflow path RO of the connection space SC of the dipping member 300 through the communication hole 311 of the dipping member 300. Thereafter, the refrigerant may flow through the refrigerant outflow path RO of the connection space SC of the dipping member 300 to the refrigerant flow path RR of the evaporator body 200, and may then flow in the refrigerant flow path RR.

At least a portion of the partition member 310 may pass through the refrigerant flow path RR of the evaporator body 200 to extend to the evaporator body 200, as illustrated in FIGS. 4 and 5. Therefore, all of the refrigerant flowing through the refrigerant flow path RR of the evaporator body 200 may flow in the connection space SC of the dipping member 300.

In addition, at least a portion of the partition member 310 may be in contact with the dipping member 300 and the evaporator body 200. For example, the partition member 310 may be connected to the dipping member 300 and the evaporator body 200 by brazing, such that at least a portion of the partition member 310 may be in contact with the dipping member 300 and the evaporator body 200.

A portion of the partition member 310 extending to the evaporator body 200 may be in contact with the heater 400 to support the heater 400. To this end, the partition member 310 may be provided with a through support portion 312, as illustrated in FIGS. 2 and 5. At least a portion of the through support portion 312 of the partition member 310 may be in contact with the heater 400, to pass through and support the heater 400. For example, the through support portion 312 may be connected to the heater 400 by brazing, such that at least a portion of the through support portion 312 may be in contact with the heater 400.

Therefore, when ice I is removed as illustrated in FIG. 6, heat generated by the heater 400, at least partially inserted into the refrigerant flow path RR of the evaporator body 200, may be easily transferred to the dipping member 300 through the partition member 310, such that the ice I may be separated from the dipping member 300 more easily.

The dipping member 300 and the partition member 310 may be formed of a thermally conductive material. For example, the dipping member 300 and the partition member 310 may be formed of metal such as stainless steel. A material constituting the dipping member 300 and a material constituting the partition member 310 are not particularly limited, and any known material may be used as long as they are connected to the evaporator body 200 or provided in the dipping member 300.

At least a portion of the heater 400 may be inserted into the refrigerant flow path RR of the evaporator body 200. In addition, the heater 400 may directly or indirectly heat at least one of the refrigerant in the refrigerant flow path RR of the evaporator body 200, the evaporator body 200, and the dipping member 300. As a result, the ice I generated on the dipping member 300 may be separated from the dipping member 300. For example, the ice I generated on the dipping member 300 may be separated from the dipping member 300 by heating of the heater 400, in a state in which the tray member TR rotates so as not to interfere with the separation of the ice I, as illustrated in FIG. 7.

In this manner, since the ice I is separated from the dipping member 300 by heating the refrigerant, or the evaporator body 200 or the dipping member 300 by the heater 400, there may be no need for a flow path switching valve (not illustrated) or the like for flowing a refrigerant having a temperature higher than a freezing point of water into the refrigerant flow path RR of the evaporator body 200, to remove ice. Therefore, when the ice I is separated from the dipping member 300, occurrence of noise may be minimized.

The heater 400 may pass through the connection member 500 connected to the evaporator body 200, such that at least a portion of the heater 400 may be inserted into the refrigerant flow path RR of the evaporator body 200. Therefore, since the heater 400 is in contact with the refrigerant existing in the refrigerant flow path RR of the evaporator body 200, the evaporator body 200 or the dipping member 300 may not be heated to a high temperature by the heater 400, and may be heated only enough to separate the ice I generated on the dipping member 300. Therefore, resistance to corrosion of the evaporator 100 may not be lowered.

At least a portion of the heater 400, for example, an upper portion of the heater 400 may be in contact with the evaporator body 200, as illustrated in FIG. 5. Thereby, the evaporator body 200 may also be heated by the heater 400. For example, the heater 400 may be connected to the evaporator body 200 by brazing, to contact the evaporator body 200.

The heater 400 may include a heater body 410, a heating element 420, and a fuse 430, as illustrated in FIG. 3.

The heater body 410 may have, for example, a tubular shape in which one side is closed and the other side is open. In addition, the heating element 420, and a portion of an electric wire 421 electrically connecting the heating element 420 and a power source (not illustrated) may be provided to be inserted into the heater body 410 through the open other side of the heater body 410. In this case, the electric wire 421 provided inside the heater body 410 may be protected to be inserted into a protective tube TP, as illustrated in FIG. 3.

In addition, in a state in which the heating element 420 and a portion of the electric wire 421 may be inserted into the heater body 410, the open other side of the heater body 410 may be closed by a closing member 411 through which the electric wire 421 passes, as illustrated in FIG. 3.

A shape and a configuration of the heater body 410 are not particularly limited, and any shape and configuration may be used as long as the heating element 420 and a portion of the electric wire 421 electrically connecting the heating element 420 and the power source are provided inside the heater body 410.

The heating element 420 may be provided inside the heater body 410, as described above. In addition, the heating element 420 may be electrically connected to the power source by, for example, the electric wire 421. When ice I having a predetermined size is generated on the dipping member 300, electricity of the power source may be applied to the heating element 420. Thereby, at least one of the refrigerant in the refrigerant flow path RR of the evaporator body 200, the evaporator body 200, and the dipping member 300 may be directly or indirectly heated by the heater 400, and the ice I generated on the dipping member 300 may be separated from the dipping member 300, as illustrated in FIG. 7. The heating element 420 is not particularly limited, and any known material may be possible as long as it is provided inside the heater body 410 and is electrically connected to a power source to generate heat when electricity of the power source is applied.

The fuse 430 may cut off electrical connection between the heating element 420 and the power source when the heating element 420 generates heat having an abnormal heating temperature. Thereby, the heater 400, the evaporator body 200, the dipping member 300, or the like heated by the heater 400, or an ice maker (not illustrated) in which the evaporator 100 is installed, may not be damaged or deformed due to abnormal heat generation by the heater 400.

The fuse 430 may be electrically connected to the heating element 420 and the power source outside the heater body 410, after brazing a group selected from the groups consisting of the evaporator body 200 and the dipping member 300, the partition member 310 and the dipping member 300, the heater 400 and the through support portion 312, the heater 400 and the evaporator body 200, or the like. Therefore, it may prevent the fuse 430 from being damaged by heat caused by the brazing. For example, the fuse 430 may be provided on a portion of the electric wire 421 outside the heater body 410, and may be electrically connected to the heating element 420 and the power source.

The connection member 500 may be connected to the evaporator body 200 such that the refrigerant flow path RR of the evaporator body 200 is connected to the refrigeration cycle. In addition, the connection member 500 may allow at least a portion of the heater 400 to be inserted into the refrigerant flow path RR of the evaporator body 200. For example, at least a portion of the heater 400 may pass through the connection member 500, and may be inserted into the refrigerant flow path RR of the evaporator body 200.

A connection flow path RC may be formed in the connection member 500. The connection flow path RC may be connected to the refrigerant flow path RR of the evaporator body 200 and the refrigeration cycle, and may pass through at least a portion of the heater 400, as illustrated in FIG. 4.

One side of the connection member 500 may be connected to the evaporator body 200, such that the connection flow path RC may be connected to the refrigerant flow path RR of the evaporator body 200. For example, as illustrated in FIG. 4, one side of the connection member 500 may be inserted into the refrigerant flow path RR and connected to the evaporator body 200, such that the connection flow path RC may be connected to the refrigerant flow path RR of the evaporator body 200.

Connection pipes PC1 and PC2 connected to the refrigeration cycle may be connected to the other side of the connection member 500 to be connected to the connection flow path RC. For example, a first connection pipe PC1 connected to a capillary tube or an expansion valve included in the refrigeration cycle may be inserted into and connected to the other side of the connection member 500 connected to one side of the refrigerant flow path RR of the evaporator body 200. In addition, a second connector PC2 connected to a compressor included in the refrigeration cycle may be inserted into and connected to the other side of the connection member 500 connected to the other side of the refrigerant flow path RR of the evaporator body 200. At least portions of the connection pipes PC1 and PC2 may be inserted into a heat insulating member IS, as illustrated in FIGS. 1, 2, and 4. A portion of the electric wire 421 may also be inserted into the heat insulating member IS.

At least a portion of the heater 400 may pass through the other side of the connection member 500, and may pass through the connection flow path RC, to be inserted into the refrigerant flow path RR.

To this end, a through-hole 510 and a connection hole 520 respectively connected to the connection flow path RC may be formed on the other side of the connection member 500, as illustrated in FIG. 2. In addition, at least a portion of the heater 400 may sealedly pass through the through-hole 510, as illustrated in FIG. 4. In addition, at least portions of the connection pipes PC1 and PC2 may be sealedly connected to the connection hole 520.

As illustrated in FIG. 4, a diameter D1 of at least a portion of the connection member 500 may be greater than the sum of a diameter D2 of the heater 400 and a diameter D3 of the connection pipe PC1 or PC2. Thereby, at least a portion of the heater 400 and at least portions of the connection pipes PC1 and PC2 do not interfere with each other, may sealedly pass through the through-hole 510 of the connection member 500, respectively, and may be sealedly connected to the connection hole 520 of the connection member 500, respectively.

Second Embodiment of Evaporator for Ice Maker

Hereinafter, a second embodiment of an evaporator for an ice maker, according to the present invention, will be described with reference to FIGS. 8 to 11.

Figure 8:
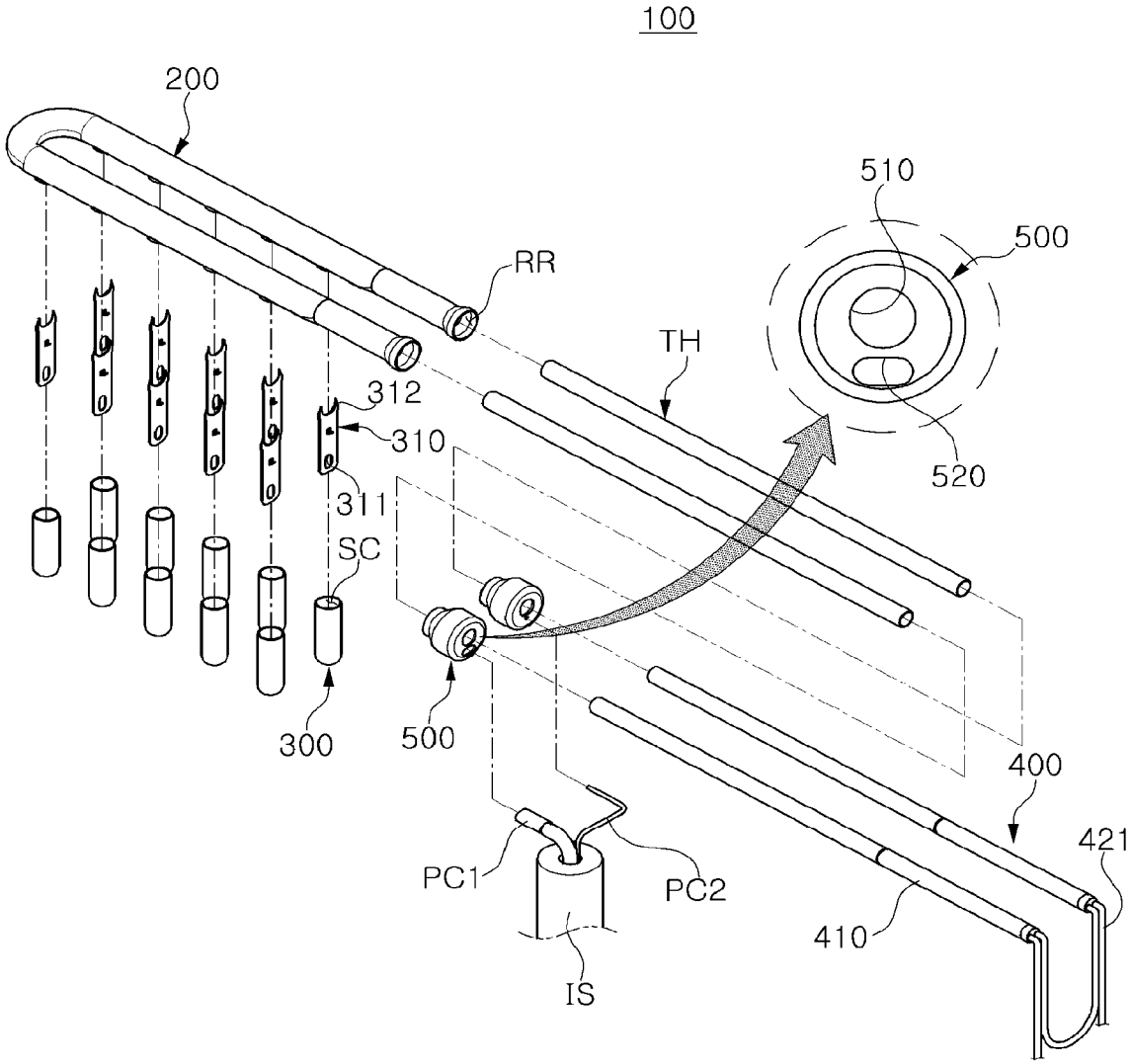
FIG. 8 is an exploded perspective view of a second embodiment of an evaporator for an ice maker, according to the present invention.
Figure 9:
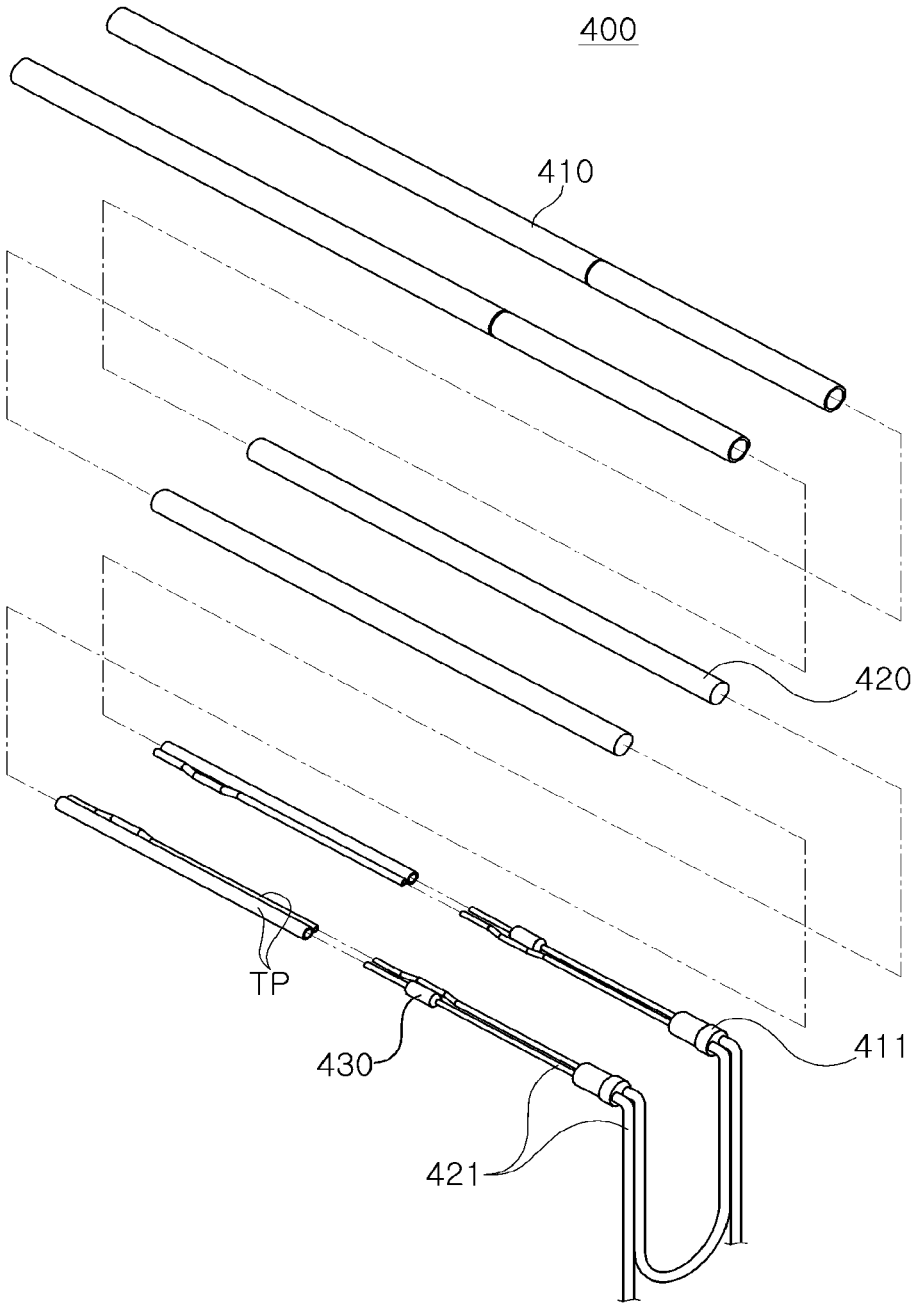
FIG. 9 is an exploded perspective view illustrating a heater of a second embodiment of an evaporator for an ice maker, according to the present invention.

FIG. 8 is an exploded perspective view of a second embodiment of an evaporator for an ice maker, according to the present invention, and FIG. 9 is an exploded perspective view illustrating a heater of a second embodiment of an evaporator for an ice maker, according to the present invention.

Figure 10:
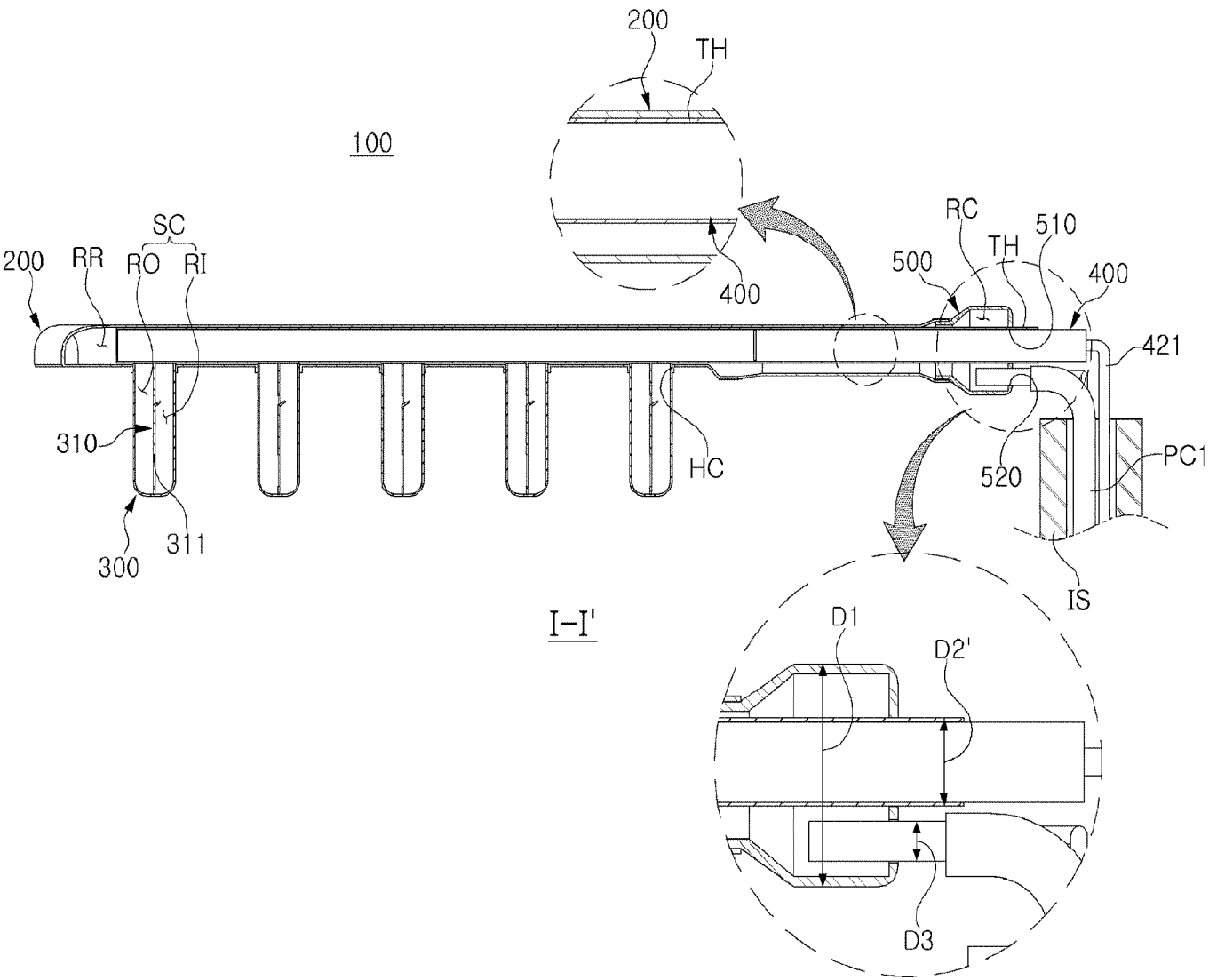
FIG. 10 is a cross-sectional view of a second embodiment of an evaporator for an ice maker, according to the present invention, similar to that of FIG. 4.
Figure 11:
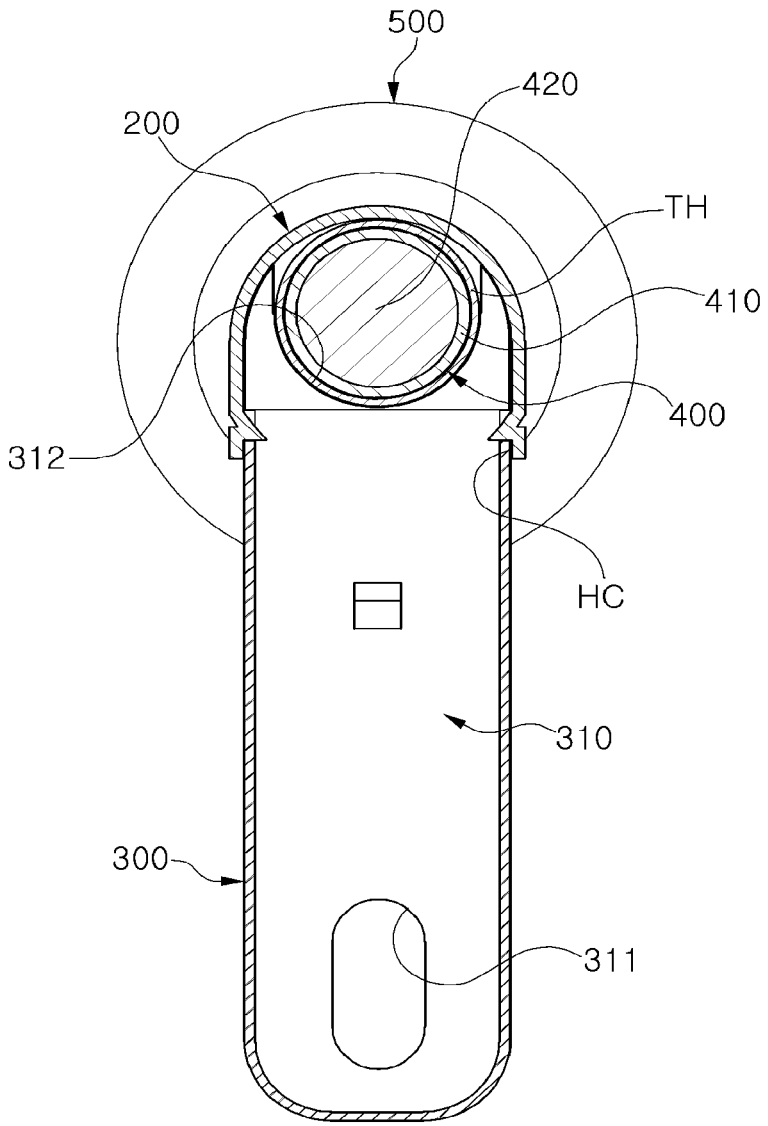
FIG. 11 is a cross-sectional view of a second embodiment of an evaporator for an ice maker, according to the present invention, similar to that of FIG. 5.

Further, FIG. 10 is a cross-sectional view of a second embodiment of an evaporator for an ice maker, according to the present invention, similar to that of FIG. 4, and FIG. 11 is a cross-sectional view of a second embodiment of an evaporator for an ice maker, according to the present invention, similar to that of FIG. 5.

In this case, a second embodiment of an evaporator for an ice maker, according to the present invention, may be different from the first embodiment of an evaporator for an ice maker, according to the present invention described with reference to FIGS. 1 to 7, in view of the facts that at least a portion of a heater insertion pipe TH into which at least a portion of a heater 400 is inserted passes through a connection member 500 and is inserted into a refrigerant flow path RR of an evaporator body 200.

Therefore, in the following description, different configurations will be mainly described, and remaining configurations may be replaced with those described with reference to FIGS. 1 to 7.

In a second embodiment of an evaporator for an ice maker, according to the present invention, at least a portion of a heater insertion pipe TH into which at least a portion of a heater 400 is inserted may pass through a connection member 500 and may be inserted into a refrigerant flow path RR of an evaporator body 200.

The heater insertion pipe TH may be configured to close one side and open the other side, and at least a portion of the heater 400 may be inserted into the opened the other side of the heater insertion pipe TH.

In this manner, when at least a portion of the heater 400 is inserted into the heater insertion pipe TH, at least a portion of the heater insertion pipe TH, not the heater 400, may pass through the other side of the connection member 500, and may pass through a connection flow path RC, to be inserted into the refrigerant flow path RR of the evaporator body 200. Therefore, as illustrated in FIG. 10, at least a portion of the heater insertion pipe TH may sealedly pass through a through-hole 510 formed on the other side of the connection member 500.

In addition, since the one side of the heater insertion pipe TH inserted in the evaporator body 200 has a closed structure as described above, although at least a portion of the heater 400 is inserted into the refrigerant flow path RR of the evaporator body 200, the heater 400 may not be in contact with a refrigerant in the refrigerant flow path RR of the evaporator body 200. Therefore, although the heater 400 is separated from the heater insertion pipe TH, since a refrigeration cycle may be maintained and there may be no leakage of the refrigerant from the refrigerant flow path RR of the evaporator body 200, there may be advantages that easy repairing or replacement of the heater 400 is possible. In addition, since it is possible to assemble the heater 400 in a last process after the heater insertion pipe TH is inserted into the evaporator body 200, assembling of the heater 400 may be facilitated.

And, as illustrated in FIG. 10, a diameter D1 of at least a portion of the connection member 500 may be greater than the sum of a diameter D2' of the heater insertion pipe TH and a diameter D3 of the connection pipe PC1 or PC2.

In addition, a portion of a partition member 310 extending to the evaporator body 200 may be in contact with the heater insertion pipe TH to support the heater insertion pipe TH. To this end, as illustrated in FIG. 11, at least a portion of a through support portion 312 of the partition member 310 may be in contact with the heater insertion pipe TH such that the heater insertion pipe TH may pass through the through support portion 312 and be supported by the through support portion 312. In addition, at least a portion of the heater insertion pipe TH, for example, an upper portion of the heater insertion pipe TH may be in contact with the evaporator body 200.

Therefore, since the heater insertion pipe TH, not the heater 400, may be connected to the through support portion 312 or the evaporator body 200 by brazing, it may prevent a fuse 430 of the heater 400 from being damaged by heat caused by brazing. Therefore, the fuse 430 of the heater 400 may be electrically connected to the heating element 420 and a power source inside the heater body 410 as illustrated in FIG. 9.

As described above, when an evaporator for an ice maker, according to the present invention, is used, at least a portion of a heater separating ice generated by an evaporator may be inserted into a refrigerant flow path formed in the evaporator for a refrigerant to flow, generation of noise when the ice generated by the evaporator is separated may be minimized, and resistance to corrosion of the evaporator may not decrease due to the separation of the ice generated by the evaporator.

An evaporator for an ice maker, described above, is not limited to the configuration of the above-described embodiments, but the embodiments may be configured by selectively combining all or portion of each embodiment to accomplish various modifications.

While example embodiments have been illustrated and described above, it will be apparent to those skilled in the art that modifications and variations could be made without departing from the scope of the present invention as defined by the appended claims.

The invention claimed is:

1. An evaporator for an ice maker, comprising:

an evaporator body having a refrigerant flow path formed therein;

a protruding tube connected to the evaporator body, for a refrigerant having a temperature lower than a freezing point of water to flow in the refrigerant flow path to generate ice in a state in which at least a portion of the protruding tube is submerged in water;

a heater having at least a portion inserted into the refrigerant flow path, and directly or indirectly heating at least one of the refrigerant in the refrigerant flow path, the evaporator body, and the protruding tube to separate the ice generated on the protruding tube from the protruding tube; and a coupler coupling the evaporator body, a connection pipe connected to a refrigeration cycle, and the heater, wherein the at least a portion of a heater insertion pipe into which the at least a portion of the heater is inserted passes through the coupler and is inserted into the refrigerant flow path, and the heater insertion pipe is configured to be closed on one side and open on the other side, and the at least a portion of the heater is inserted into the opened other side of the heater insertion pipe.

2. The evaporator of claim 1, wherein a connection flow path connected to the refrigerant flow path and the refrigeration cycle and through which the at least a portion of the heater or the at least a portion of the heater insertion pipe passes is formed in the coupler.

3. The evaporator of claim 2, wherein one side of the coupler is connected to the evaporator body to connect the connection flow path and the refrigerant flow path, and the connection pipe is connected to the other side of the coupler to be connected to the connection flow path, wherein the at least a portion of the heater or the at least a portion of the heater insertion pipe passes through the other side of the coupler, passes through the connection flow path, and is inserted into the refrigerant flow path.

4. The evaporator of claim 3, wherein a through-hole connected to the connection flow path and through which the at least a portion of the heater or the at least a portion of the heater insertion pipe sealedly passes, and a connection hole connected to the connection flow path and to which at least a portion of the connection pipe is sealedly connected, are formed on the other side of the coupler.

5. The evaporator of claim 3, wherein a diameter of at least a portion of the coupler is greater than the sum of a diameter of the heater or a diameter of the heater insertion pipe and a diameter of the connection pipe.

6. The evaporator of claim 3, wherein a connection space connected to the refrigerant flow path is formed in the protruding tube to flow the refrigerant in the refrigerant flow path.

7. The evaporator of claim 6, wherein the protruding tube comprises a partition partitioning the connection space into a refrigerant inflow path into which the refrigerant flows from the refrigerant flow path and a refrigerant outflow path from which the refrigerant flows into the refrigerant flow path.

8. The evaporator of claim 7, wherein the partition comprises a communication hole through which the refrigerant inflow path and the refrigerant outflow path are communicated to allow the refrigerant in the refrigerant inflow path to flow to the refrigerant outflow path.

9. The evaporator of claim 8, wherein the partition at least partially passes through the refrigerant flow path to extend to the evaporator body, and the partition is at least partially in contact with the protruding tube and the evaporator body.

10. The evaporator of claim 9, wherein a portion of the partition extending to the evaporator body is at least partially in contact with the heater or the heater insertion pipe to support the heater or the heater insertion pipe.

11. The evaporator of claim 10, wherein the partition comprises a contact surface having a shape at least partially corresponding the heater or the heater insertion pipe to pass through and support the heater or the heater insertion pipe.

12. The evaporator of claim 11, wherein the heater or the heater insertion pipe is at least partially in contact with the evaporator body.

13. The evaporator of claim 12, wherein at least one group selected from the groups consisting of the evaporator body and the protruding tube, the partition and the protruding tube, the heater or heater insertion pipe and the contact surface, or the heater or heater insertion pipe and the evaporator body is connected by brazing.

14. The evaporator of claim 13, wherein the heater comprises a heater body, a heating element provided inside the heater body and electrically connected to a power source, and a fuse blocking electrical connection between the heating element and the power source when the heating element generates heat having an abnormal heating temperature.

15. The evaporator of claim 14, wherein, when the heater is not inserted into the heater insertion pipe, the fuse is electrically connected to the heating element and the power source outside the heater body after the brazing, and when the heater is inserted into the heater insertion pipe, the fuse is electrically connected to the heating element and the power source inside the heater body.

* * * * *